United States Patent [19]

Powell

[11] Patent Number: 4,811,659

[45] Date of Patent: Mar. 14, 1989

[54] ROLLER PRESS FOR LIQUID/SOLID SEPARATION

[76] Inventor: Roger A. Powell, 740 Jefferson St., Red Hill, Pa. 18076

[21] Appl. No.: 148,289

[22] Filed: Jan. 25, 1988

[51] Int. Cl.[4] ..... B30B 9/06

[52] U.S. Cl. ..... 100/118; 100/121; 162/274; 162/279; 162/358; 162/364; 210/386

[58] Field of Search ..... 100/118, 119, 120, 121, 100/90, 157, 151; 162/358, 274, 276, 279, 368, 369; 210/401, 326, 386

[56] References Cited

U.S. PATENT DOCUMENTS

| | | | |
|---|---|---|---|
| 880,035 | 2/1908 | Neilsen | 100/118 |
| 1,577,839 | 3/1926 | Moone | 210/386 |
| 2,094,863 | 10/1937 | Young | 210/386 |
| 2,308,031 | 1/1943 | Schmitz | 210/326 |
| 3,278,368 | 10/1966 | Wicker | 162/358 |
| 3,364,103 | 1/1968 | Kusters | 100/121 |
| 3,631,794 | 1/1972 | Wehner | 100/121 |

FOREIGN PATENT DOCUMENTS

| | | | |
|---|---|---|---|
| 843735 | 6/1952 | Fed. Rep. of Germany | 100/121 |
| 197809 | 9/1978 | Fed. Rep. of Germany | 100/121 |

*Primary Examiner*—Peter Feldman

[57] ABSTRACT

A roller press comprised of two opposed porous tubular sleeves which are forced together to form a nip by inner driven rollers. Liquid from a mixture fed through the nip is forced into the porous rollers and is transported by them to another circumferential location where the liquid is forced out by a compressed air stream. Filtration belts cover portions of the porous rollers in the areas of the nip.

15 Claims, 1 Drawing Sheet

ROLLER PRESS FOR LIQUID/SOLID SEPARATION

BACKGROUND

In the industrial processing sector, there is a need to separate the liquid component from the solid component of numerous mixtures. The efficiency of the processes available to perform this function decreases as the liquid content decreases. If the liquid content is less than 20% by weight, the processes and equipment available have a limited throughput. One object of this invention is to provide a process and equipment that will rapidly and effeciently separate liquids from liquid/solids mixtures in this region of operation.

Roller presses have been previously described to perform a de-liquifying function. U.S. Pat. No. 3,520,251 to Bodine describes a roller press having porous metal rollers through which the liquid passes into the interior, from which it is discharged. Kerr describes in U.S. Pat. No. 3,968,742, a similar arrangement. Both of these inventions use a unidirectional liquid flow (from the outer surface to the inner surface) that can also transport small particles of the solid material into the passageways in the rollers. This can cause the roller passageways to eventually become clogged, causing the liquid movement to be reduced. One object of this invention is to provide a reversing liquid flow: liquid flows from the mixture into the outer surface of the roller at the nip and is later forced back to the outer surface of the roller for removal. The reversing liquid flow provides a cleaning action to the passageways in the rollers to minimize clogging. Another object is to provide a filtration barrier between the mixture and the rollers to further reduce clogging. Also, the rollers rotate about bearings mounted on their endplates and are therefore subjected to bending stresses. This requires additional strength in the design of the roller, making them complex to construct and therefore expensive to produce. Another object of this invention is simplify the construction and reduce the cost. Further, the endplates effectively preclude access to the interior of the roller which limits the available methods for removal of the liquid. Another object of this invention is to eliminate the endplates and provide greater access to the interior of the rollers.

SUMMARY OF THE INVENTION

The invention is comprised of two opposed, counter-rotating porous rollers that create a narrow, high-pressure nip area between them. Through the nip is passed the mixture of liquid and solids. As the mixture is exposed to the high pressure, the liquid portion is forced into the pores of the rollers. As the rollers rotate from the nip, they enter regions where the roller material is exposed to a high internal air pressure causing the entrained liquid to be forced to the outer surface of the roller and be blown into a receiver which can be operated under a suction. The de-liquified section of the rollers rotate back to the nip to accept more liquid. The porous rollers are rotated by contact friction with driven inner roller near the nip. The inner rollers also support the compression forces at the nip. The compression force of the nip can be created by having one inner roller on a moving frame which is urged toward the other inner roller by hydraulic cylinders. Since the reaction forces of the nip are carried by the inner rollers internal to the porous rollers at the nip, the porous material is subjected to only compressive stresses between the inner roller and the mixture in the nip. This arrangement allows the porous rollers to be a simple sleeve without endplates or end journals for bearings. This greatly reduces the complexity of manufacture and the strength requirements of the porous material, both of which reduce costs. Also, a significant area free of end plates or closures is available for the de-liquifying equipment. The invention also incorporates a filter belt that passes over the porous rollers in the nip area to reduce the infiltration of solid particles into the porous material. The mixture may be fed into the nip from a pressurized hopper having sealing devices against the rollers. The pressurization of the hopper restricts the backflow of liquid from the nip into the hopper. The pressurization can be created by the action of a extruder screw similar to those used in plastic injection molding presses.

BRIEF DESCRIPTION OF THE DRAWINGS

FIG. 1 is a plan view of the invention.

FIG. 2 is a sectional view of the invention showing an end elevation.

DETAILED DESCRIPTION OF THE DRAWINGS

Figure 1:
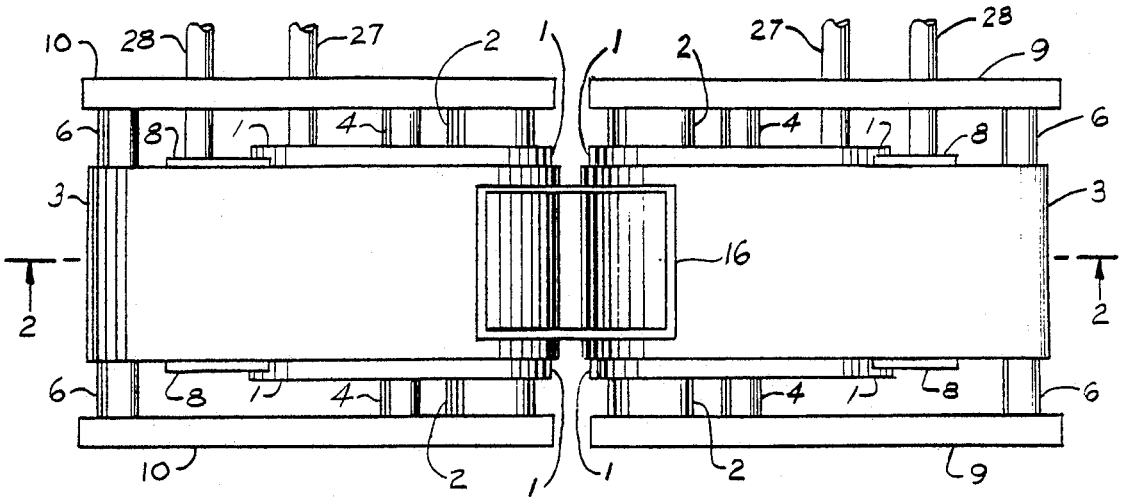
FIGS. 1 & 2 show the preferred embodiment of the invention.
Figure 2:
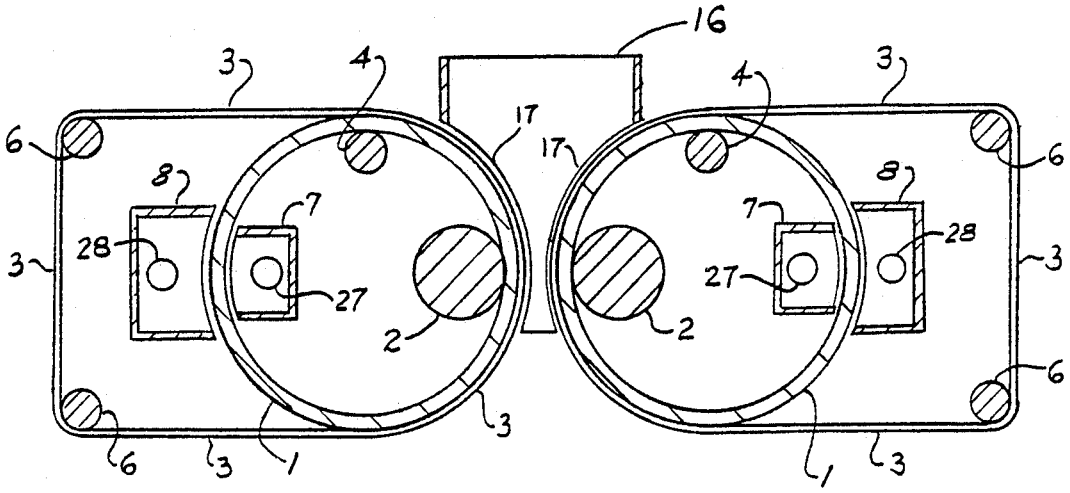

In FIGS. 1 and 2, there are two porous rollers 1 that are made of a sintered material such as sintered steel, stainless steel or bronze. The sintering process produces a micro-porosity in the material. The porous roller axes are parallel and the area between them is the nip. Each porous roller 1 is a cylindrical sleeve with its inner surface in contact with the outer surface of a inner roller 2 in the vicinity of the nip area. Inner rollers 2 are supported by frames 9 & 10 in bearing such that inner rollers 2 can rotate about their axes. Inner rollers 2 are driven by suitable motors and gearboxes (which are not shown but are well known by those skilled in the art) such that, in FIG. 2, the right hand inner roller 2 rotates counter-clockwise and the left hand roller 2 rotates clockwise.

Small pinch rollers (not shown) may be mounted on the frames 9 & 10 to contact the outer surface of each porous roller near their edges in the area of the nip to exert a force on each porous roller that urges it toward its inner roller so that contact between each porous roller and its respective inner roller is maintained if there is not mixture in the nip. The contact between the porous rollers 1 and their respective inner rollers 2 causes the porous rollers to rotate in the same direction as their respective inner rollers 2. Support rollers 4 are in contact with the inner surfaces of the porous rollers 1 to maintain the position of the porous rollers 1. The support rollers 4 have their outer ends attached to frames 9 & 10 through rotary bearings. Air manifolds 7 are mounted on frames 9 & 10 and are located close to the inner surfaces of the porous rollers 1 and are supplied with compressed air through conduit 27. The compressed air is directed from the air manifolds 7 through the porous roller 1 from the inside to the outside exiting at the corresponding outer surface. In its passage through the porous roller, the compressed air forces out liquid and solid particles that have been picked up at the nip in the reverse direction that they entered the porous roller. The compressed air, liquid, and any small solid particles are captured in receivers 8, which are under a suction from conduit 28 from an appropriate suction source (not shown) and transported through conduits 28 for collection. The receivers are mounted to frames 9 and 10 and are located close to the outer surface of each porous roller. A belt 3 covers a portion of the surface of the porous roller including the nip area. The belt is made of a filtration membrane material such as expanded polytetrafluoroethylene (PTFE) with pore sizes less than the pore sizes of the porous roller. The belt 3 acts as a barrier to small solid particles while allowing the liquid to pass through relatively unimpeded. The belt 3 does not absorb a significant portion of the liquid passing through it. The belts 3 are supported by idler rollers 6 where the belts 3 are not in contact with the porous rollers 1. The idler rollers 6 are supported by the frames 9 & 10 through rotary bearings. The friction due to contact with each porous roller 1 serves to drive each belt 3. A belt cleaning station may be located adjacent to each belt and mounted on the frames 9 & 10 to ensure that the characteristics of the belt 3 are maintained and not degraded by an accumulation of small solid particles. The cleaning station would use a compressed air stream passing through the belt 3 from inside to outside. In FIG. 2, the right hand frame 9 is attached to a hydraulic cylinder (not shown) that acts to urge frame 9 toward left hand frame 10, thereby acting to exert compressive forces on the mixture passing through the nip.

Located between the porous rollers 1 and above the nip is the hopper 16 which is an open chute which directs the mixture to the nip. The edges of the hopper 17 that would contact the belt 3 are provided with rubbing type seals, typically made of an elastomeric material. Alternatively, the mixture can be fed into a closed hopper by a screw in a screw housing that is rotated by a motor. The screw may have flights of decreasing pitch which act to pressurize the mixture in the closed hopper in the same manner as extrusion screws in plastic injection molding machines. Pressurizing the hopper can eliminate the need for urging the frame 9 toward frame 10 under the influence of hydraulic cylinders to produce compressive forces on the nip. Another embodiment replaces one of the porous rollers and inner roller combination, its associated belt and liquid removal station with a reaction roller having a solid surface. All of the separated liquid is not removed by the remaining porous roller and its remaining associated equipment. The reaction roller only provides a surface against which the mixture is pressed. Since a number of elements are eliminated, this embodiment is less expensive to construct. Although the performance may be lower than the two porous roller embodiment, it may be economically satisfactory for some mixtures. Another embodiment of this invention eliminates the filter belt 3 and its associated rollers 6. This reduces the complexity of the invention and would function satisfactorily if the characteristics of the solid particles in the mixture are such that they do not degrade the porosity of the porous roller 1. Of course, there are other arrangements of inner rollers that will support the porous roller and generate the compressive forces at the nip. Similiarly, there are other arrangements of the liquid collection components that can give adequate performance for some mixtures.

While this invention has been described in conjunction with the preferred embodiment thereof, it is obvious that modifications and changes therein may be made by those skilled in the are to which it pertains without departing from the spirit and scope of this invention, and as defined by the claims appended hereto.

I claim:

1. A roller press for separating a portion of the liquid component from a mixture of liquid and solids, comprising:

a. a first porous roller, having a cylindrical inner surface and a cylindrical outer surface, b. a second porous roller, having a cylindrical inner surface and a cylindrical outer surface, said second porous roller having its axis parallel to the axis of said first porous roller and having said outer cylindrical surface spaced apart from said outer cylindrical surface of said first porous roller, thereby creating a nip, c. a first inner roller, having a diameter small than than the diameter of said inner cylindrical surface of said first porous roller, and being in linear contact with said inner cylindrical surface in proximity to said nip, d. a second inner roller, having a diameter smaller than the diameter of said inner cylindrical surface of said second porous roller, and being in linear contact with said inner cylindrical surface in proximity to said nip, e. means for supporting the ends of said first inner roller and said second inner roller, wherein said rollers can rotate about their respective axes, f. means for rotating said first inner roller and said second inner roller in counter-rotating directions, thereby causing said first porous roller and said second porous roller to rotate in the same direction as said first inner roller and said second inner roller respectively, g. means for supplying said mixture into said nip in substantially the same direction as the motion of said outer cylindrical surfaces of said first porous roller and said second porous roller at said nip, thereby subjecting said mixture to a compressing action at said nip, thereby causing said liquid to be forced into said first porous roller and said second porous roller, h. means for removing said liquid from said first porous roller and said second porous roller at locations displaced from said nip, said means comprising a compressed air stream directed at said inner cylindrical surface of said first porous roller and a compressed air stream directed at said inner cylindrical surface of said second porous roller, thereby locally pressurizing said inner cylindrical surfaces and forcing said liquid out of corresponding outer cylindrical surfaces.

2. A roller press as recited in claim 1, further comprising:

a first filtration belt in contact with a portion of said outer cylindrical surface of said first porous roller, said portion of said surface including said nip, a first support roller in contact with the inner surface of said first belt, maintaining separation between said first belt and said outer cylindrical surface of said first porous roller, a second filtration belt in contact with a portion of said outer cylindrical surface of said second porous roller, said portion of said surface including said nip, a second support roller in contact with the inner surface of said second belt, maintaining separation between said second belt and said outer cylindrical surface of said second porous roller.

3. A roller press as recited in claim 2, wherein said first filtration belt and said second filtration belt are constructed of expanded polytetrafluoroethylene.

4. A roller press as recited in claim 2, further comprising means to remove liquid and solid particles from said filtration belts.

5. A roller press as recited in claim 1, wherein said means for removing said liquid from said first porous roller and said second porous roller further comprises receivers located at and decoupled from the outer cylindrical surfaces of said first porous roller and said second porous roller, said receivers applying a suction to said outer cylindrical surfaces of said porous rollers.

6. A roller press as recited in claim 1, further comprising means for externally and supplimentally pressurizing said mixture prior to supplying said mixture to said nip.

7. A roller press as recited in claim 6, wherein said means for externally pressurizing comprises a closed hopper being fed said mixture by an extrusion screw.

8. A roller press as recited in claim 1, wherein said first porous roller and said second porous roller are constructed of a sintered metallic material.

9. A roller press for separating a portion of the liquid component from a mixture of liquid and solids, comprising:

a. a porous roller, having a cylindrical inner surface and a cylindrical outer surface, b. a reaction roller, having a cylindrical outer surface, said reaction roller having its axis parallel to the axis of said porous roller and having said outer cylindrical surface spaced apart from said outer cylindrical surface of said porous roller, thereby creating a nip, c. an inner roller, having a diameter smaller than than the diameter of said inner cylindrical surface of said porous roller, and being in linear contact with said inner cylindrical surface in proximity to said nip, e. means for supporting the ends of said reaction roller and said inner roller, wherein said rollers can rotate about their respective axes, f. means for rotating said reaction roller and said inner roller in counter-rotating directions, thereby causing said porous roller to rotate in the same direction as said inner roller, g. means for supplying said mixture into said nip in substantially the same direction as the motion of said outer cylindrical surfaces of said porous roller and said reaction roller at said nip, thereby subjecting said mixture to a compressing action at said nip, thereby causing said liquid to be forced into said porous roller, h. means for removing said liquid from said porous roller at a location displaced from said nip, said means comprising a compressed air stream directed at said inner cylindrical surface of said porous roller, thereby locally pressurizing said inner cylindrical surface and forcing said liquid out of the corresponding outer cylindrical surface.

10. A roller press as recited in claim 9, further comprising:

a continuous filtration belt in contact with a portion of said outer cylindrical surface of said porous roller, said portion of said surface including said nip, a support roller in contact with the inner surface of said belt, maintaining separation between said belt and said outer cylindrical surface of said porous roller, 11. A roller press as recited in claim 10, wherein said filtration belt is constructed of expanded polytetrafluoroethylene.

12. A roller press as recited in claim 9, further comprising means for externally and supplimentally pressurizing said mixture prior to supplying said mixture to said nip.

13. A roller press as recited in claim 12, wherein said means for externally pressurizing comprises a closed hopper being fed said mixture by an extrusion screw.

14. A roller press as recited in claim 9, wherein said means for removing said liquid from said porous roller further comprises a receiver located at and decoupled from said outer surface of said porous roller, said receiver applying a suction to said porous roller.

15. A rolller press as recited in claim 9, wherein said porous roller is constructed of a sintered metallic material.

* * * * *